US006099203A

United States Patent [19]

Landes

[11] Patent Number: 6,099,203

[45] Date of Patent: Aug. 8, 2000

[54] MARKER POST HAVING A WEBBED TRIANGULAR CROSS SECTION

[76] Inventor: Scott D. Landes, 9906 Kell Ave. So., Bloomington, Minn. 55437

[21] Appl. No.: 09/014,392

[22] Filed: Jan. 27, 1998

[51] Int. Cl.[7] ..... E01F 9/00; E01F 13/00; E04C 3/30

[52] U.S. Cl. ..... 404/10; 49/49; 116/63 R; 116/63 T; 52/720.1

[58] Field of Search ..... 116/63 R, 63 T; 404/9, 10; 49/49; 52/720.1, 720.2, 736.1, 724.3, 721.3, 722.1; 40/608, 606, 605; 256/1, 19

[56] References Cited

U.S. PATENT DOCUMENTS

| | | | |
|---|---|---|---|
| Re. 26,779 | 2/1970 | Weichenrieder | 116/63 |
| 141,971 | 8/1873 | Warner . | |
| 726,801 | 4/1903 | Maxwell | 52/720.1 |
| 1,726,817 | 9/1929 | Franklin . | |
| 1,916,787 | 7/1933 | Elston . | |
| 2,068,937 | 1/1937 | Vaughan | 88/79 |
| 2,616,196 | 11/1952 | Sandahl, Jr. et al. | 40/145 |
| 2,625,762 | 1/1953 | McColl | 40/145 |
| 3,066,769 | 12/1962 | Pasquale | 189/29 |
| 3,279,133 | 10/1966 | De Korte | 52/103 |
| 3,371,647 | 3/1968 | Shopbell | 116/114 |
| 3,381,763 | 5/1968 | Matson | 173/91 |
| 3,519,234 | 7/1970 | Matson | 248/156 |
| 3,570,376 | 3/1971 | Overton, III et al. | 52/736.1 |
| 3,802,135 | 4/1974 | Weichenrieder | 52/98 |
| 4,007,574 | 2/1977 | Riddell | 52/722 |
| 4,023,683 | 5/1977 | Vargo | 211/192 |
| 4,061,435 | 12/1977 | Schmanski et al. | 404/10 |
| 4,078,867 | 3/1978 | Ronden | 404/10 |
| 4,084,914 | 4/1978 | Humphry et al. | 404/10 |
| 4,092,081 | 5/1978 | Schmanski | 404/10 |
| 4,106,879 | 8/1978 | Diedershagen et al. | 404/10 |
| 4,123,183 | 10/1978 | Ryan | 404/10 |
| 4,240,766 | 12/1980 | Smith et al. | 404/10 |
| 4,249,357 | 2/1981 | Cornou | 52/728 |
| 4,343,567 | 8/1982 | Sauver et al. | 404/10 |
| 4,347,678 | 9/1982 | Laakso | 40/607 |
| 5,012,603 | 5/1991 | Elcock | 40/605 |
| 5,374,137 | 12/1994 | Steinberg | 404/9 |
| 5,606,815 | 3/1997 | Feldwhere | 40/607 |
| 5,809,734 | 9/1998 | Turner | 52/736.1 |

FOREIGN PATENT DOCUMENTS

| | | | |
|---|---|---|---|
| 2019686 | 4/1970 | Germany | 404/10 |
| 24 50 691 | 10/1975 | Germany | 404/10 |

*Primary Examiner*—Eileen Dunn Lillis
*Assistant Examiner*—Gary S. Hartmann
*Attorney, Agent, or Firm*—Jacobson & Johnson

[57] ABSTRACT

A marker post formed of a resilient materiel which is normally bendable without breaking, with the resilient material arranged in a triangular cross shape with internal webs therein to impart sufficient rigidity to the marker post to enable the marker post to be driven into most soils with the internal webs coacting to provide a restoring force to enable the marker post under many field conditions to return to a normally straight condition.

5 Claims, 2 Drawing Sheets

MARKER POST HAVING A WEBBED TRIANGULAR CROSS SECTION

FIELD OF THE INVENTION

This invention relates generally to marker posts and, more specifically, to the arrangement of a resilient material to form a rigid, yet resilient triangular shaped marker post that has sufficient rigidity so that the marker post can be driven into most soils while still retaining sufficient resiliency to resiliently respond to an impact thereon.

BACKGROUND OF THE INVENTION

The concept of triangular shaped signs that have three panels for displaying information is known in the are Typically, such signs are found on parking meters and are secured to the parking meter post with some type of an internal clamp. These signs usually display advertising or other information for the viewers. Such signs are useful as information can be viewed from any lateral direction of the sign.

Marker posts are known in the art and are used to place an above ground warning that a pipe line or an electrical line is buried in the soil. The marker posts must be somewhat unobtrusive yet able to warn a person of an underground utility. In addition, the marker posts must be able to withstand the environment for an extended period of time, sometimes twenty years or more. Unfortunately, during the lifetime of the individual marker post, the marker post is oftentimes subject to abuse through accidental contact with machinery working in the area of the marker post. The marker post must be able to withstand such abuse as well as be able to continue to convey a warning message of the existence of an underground hazard to those who may be proximate the marker post. Typically, marker post abuse occurs when vehicles accidentally drive over the marker post. The marker post should remain intact and be able to return to its original erect position after the forces have been removed. One such self erecting marking posts is shown in U.S. Pat. No. 4,343,567 which discloses a self erecting marking post comprised of a cylindrical marking tube that is supported by a cylindrical erecting tube that fits within the marking tube. The two cylindrical members coact to permit the marking post to return to a normal straight condition even though the marking post may be bent over by an object. Unfortunately, cylindrical marking posts do not lend themselves to displaying signs that can be seen from different directions unless separate panels are attached to the cylindrical post. U.S. Pat. No. 4,343,567 discloses that a panel can be attached to the top of the post by rivets. Such attachment of panels by rivets to circular posts is not suitable for long-term use in environmental conditions where wind buffets the sign as the wind can cause the sign to vibrate which eventually causes rivet fatigue that results in the sign falling off the marker.

The present invention provides a triangular shaped resilient one-piece marker post that has three integral information panels that are viewable from different directions. By having the information panels integral with the marker post, the information panels are not subject to separation due to weather or to vandals and can be viewed from different directions.

The marker post is made from materials that are bendable up to 90 degrees without rupture of the bendable material. However, such materials in a flat form do not have sufficient rigidity to allow the marker post to be driven into the ground. To provide the necessary rigidity to the marker post, the materials are formed into a triangular cross-sectional shape so that the marker post can be driven into most soils. In spite of rigidity imparted to the post by forming the marker post into a triangular shape, it has been discovered that a set of internal webs within the marker post coacting with the marker post causes the triangular shaped marker post to return to its normally straight condition even though the marker post may be repeatedly bent. That is, the marker post, which is made rigid by the arrangement of the material in a triangular shape retains sufficient resiliency to return to its upright condition even though the arrangement of the marker post and internal webs imparts rigidity to the marker post to enable the marker post to be driven into most soils.

DESCRIPTION OF THE PRIOR ART

U.S. Pat. No. 2,625,762 discloses a triangular sign that can be attached to a parking meter or the like.

U.S. Pat. No. 141,971 discloses a triangular advertising sign for attaching to a lamp.

U.S. Pat. No. Re. 26,779 discloses a hollow street boundary post.

U.S. Pat. No. 2,068,937 discloses a three sided concrete post.

U.S. Pat. No. 5,606,815 discloses a sign formed from a rectangular sheet of plastic by folding the panel into a triangular shape.

U.S. Pat. No. 5,012,603 discloses a modular sign which has varying thickness and can be mounted in a post.

U.S. Pat. No. 4,347,678 discloses a multi-sided display sign with an internal clamping mechanism for holding the sign onto a post.

U.S. Pat. No. 2,616,196 discloses a parking meter sign with an internal member for clamping the sign to a post.

U.S. Pat. No. 4,343,567 discloses a self-erecting roadway marking post that has a hollow cylindrical marking tube that can be bent many times through an angle of 90° and returns to a straight normal condition. Located within the marking tube is a separate reinforcing tube to assure that the marking tube remains self erecting.

U.S. Pat. No. 1,726,817 discloses a self erecting traffic signal.

U.S. Pat. No. 1,916,787 discloses a circular traffic guard.

U.S. Pat. No. 3,066,769 discloses a ground socket for holding a post.

U.S. Pat. No. 3,279,133 discloses a boundary marker with a spring to permit the boundary marker to return to an upright condition.

U.S. Pat. No. 3,371,647 discloses a foam type boundary marker for an athletic field U.S. Pat. No. 3,381,763 discloses a removal boundary penetration stake.

U.S. Pat. No. 3,519,234 discloses a removable post and driver.

U.S. Pat. No. 4,061,435 discloses a sign that will yield on contact.

U.S. Pat. No. 4,078,867 discloses a circular self erecting traffic marker post.

U.S. Pat. No. 4,084,914 discloses two piece self-erecting sign post.

U.S. Pat. No. 4,106,879 discloses a spring restrained marker post that is self erecting.

U.S. Pat. No. 4,123,183 discloses a T-shaped post that can be struck numerous times before permanent damage will occur.

SUMMARY OF THE INVENTION

Briefly, the present invention comprises a resilient marker post viewable from any lateral direction with the marker post made from resilient material characterized by being sufficiently resilient to normally bend up to 90°, yet the material lacks the rigidity to enable one to drive the material into most soils. The arrangement of the resilient material into a triangular shape provides sufficient rigidity so that the marker post can be driven into the soil without the marker post buckling or bending. Even though the marker post has sufficient rigidity to permit one to drive the marker post into most soils, it has been found that a set of internal webs coacting with the marker post enhance the ability of the marker post to return to its normal straight condition even though the marker post may have bent by impact with an object.

DESCRIPTION OF THE PREFERRED EMBODIMENT

Figure 1:
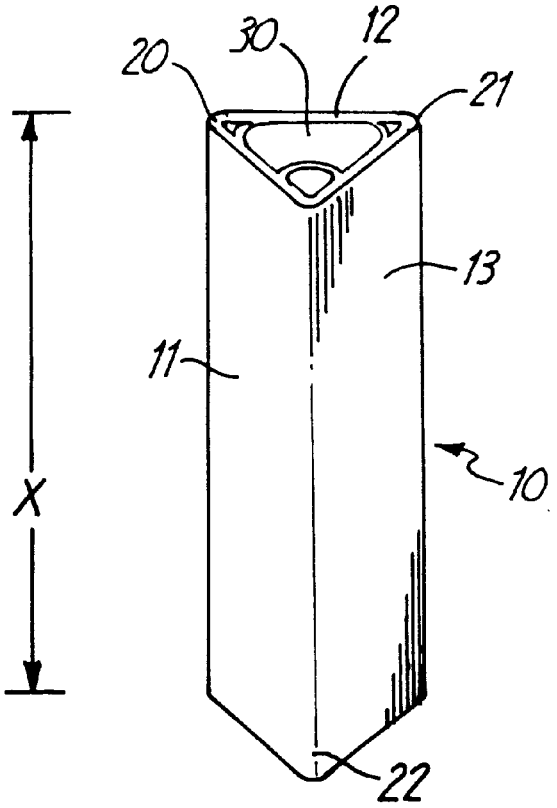
FIG. 1 is a perspective view of my triangular shaped marker post in the normally straight condition.

Referring to FIG. 1 in the drawings, reference numeral 10 generally identifies my marker post. Maker post 10 has a generally triangular cross section with the post having three elongated sides, a first panel 11, a second panel 12, and a third panel 13. The panels are connected to one another by means of three radiused corners, a first radiused corner 20, a second radiused corner 21, and a third radiused corner 22. The marking post 10 is used by driving it into the ground so that the longitudinal axis x is roughly perpendicular to the ground. The primary use of the marking post 10 is in placing it over existing objects such as pipes and utility lines to alert an individual to the presence of possible danger. An elongated chamber 30 inside of marking post 10 allows marking post 10 to form a conduit for electrical leads or the like. The marking post 10 has three sides in a roughly equilateral formation to allow an individual to see warning labels placed on the three sides from any angle. The marking post 10 is generally made of a brightly colored polycarbonate to ensure that a viewer will be able to see it from a distance.

Figure 2:
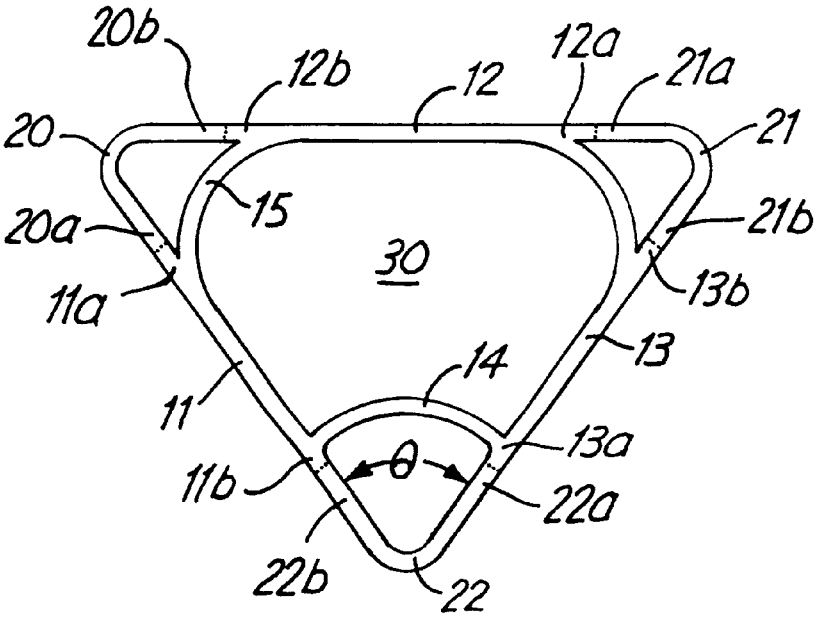
FIG. 2 is a top view of the triangular shaped marker post of FIG. 1.

FIG. 2 shows a top view of the hollow marking post 10 in a detailed fashion. Here, the triangular cross-sectional shape with internal webs can be more easily seen. The marking post 10 has a first panel 11 having a first edge 11*a* and a second edge 11*b*, a second panel 12 having a first edge 12*a* and a second edge 12*b*, a third panel 13 having a first edge 13*a* and a second edge 13*b*. Further, the marking post has a first radiused corner 20 having a first edge 20*a* and a second edge 20*b*, a second radiused corner 21 having a first edge 21*a* and a second edge 21*b*, and a third radiused corner 22 having a first edge 22*a* and a second edge 22*b*. The first edge 11*a* of first panel 11 connects in an integral fashion with the first edge 20*a* of first radiused corner 20. Second edge 20*b* of first radiused corner 20 connects in an integral way with the second edge 12*b* of the second panel 12. The first edge 12*a* of second panel 12 further connects to the first edge 21*a* of second radiused corner 21. The second edge 21*b* of second radiused corner 21 connects integrally with the second edge 13*b* of third panel 13. First edge 13*a* of third panel 13 connects integrally with the first edge 22*a* of third radiused corner 22, and the second edge 22*b* of third radiused corner 22 connects back to the second edge 11*b* of first panel 11. The angle theta that the radiused corners create is approximately 60 degrees so that the top of the cylinder has a generally equilateral triangular shape. The elongated panels and elongated radiused corners are molded into one piece to provide a hollow shell with rigid qualities to allow the marker post 10 to be driven into the ground.

Located within marker post 10 is a first internal reinforcing web 14 that extends from first panel 11 to third panel 13. Similarly, a second internal reinforcing web 15 extends from first panel 11 to second panel 12. A third internal reinforcing web 16 extends between second panel 12 and third panel 13. The reinforcing webs 14, 15, and 16 are spaced away from the radiused corners 20, 21, and 22. The reinforcing webs provide both strength and resiliency to the marking post 10 to allow the marking post 10 to stay rigid when the marker post is driven into the ground. While not fully understood, the webs coact to provide a resiliency to the marker post. Preferably, the webs are molded form a polymer plastic at the same time the outer shell of the marker post is formed. In the preferred embodiment, the marker post is molded from polycarbonate with the thickness of the webs and side walls on the order of 1/16 of an inch, and the overall dimension of about 3 inches. The length of the marker post 10 can be determined by the application. For example, some applications may require long posts and other applications may require short posts. In order that the marker post can be used with an internal support the central chamber within the marker post 10 is made sufficiently large so as to fit over a conventional metal post.

Figure 3:
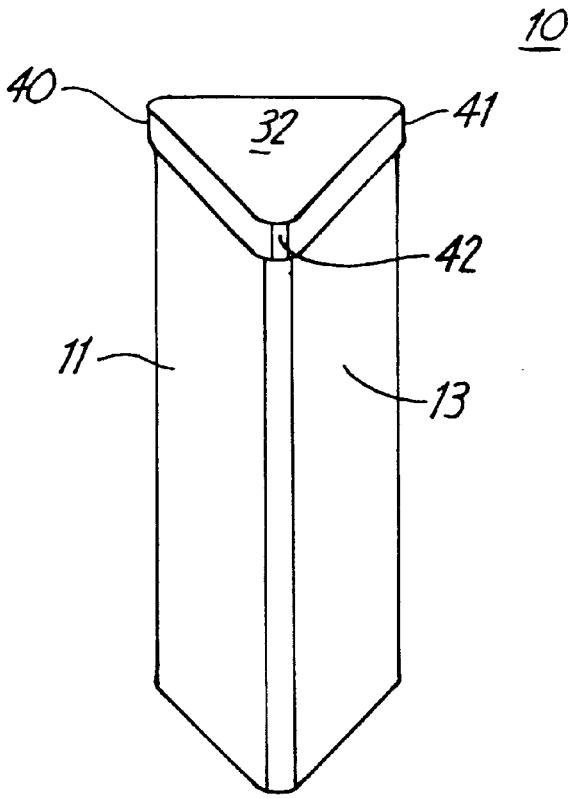
FIG. 3 shows the marker post of FIG. 1 with a cap thereon.

FIG. 3 shows the marking post 10 with a marking post cap 32 placed over the chamber. The cap prevents rainwater and other elemental forces from damaging the material inside of the marking post. A secondary use for the marking post is to allow underground electrical leads to stick up through the ground through the chamber 30 in the marking post 10 so that they can be accessed easily by simply removing the cap 32. After the wires have been configured correctly, a user can replace the cap. First cap edge 40 fits over first radiused edge 20. Similarly, second cap edge 41 fits over second radiused edge 21, and third cap edge 42 fits over third radiused corner 22.

Figure 4:
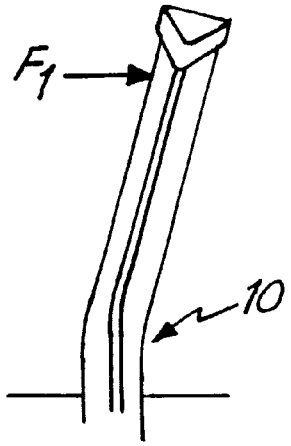
FIG. 4 shows the marker post of FIG. 1 in a bent over connection after being impacted by an object.

FIG. 4 shows the marking post 10 in an impacted position after a force has impacted the marking post 10. Even though marking post 10 has been bent, the marking post 10 contains sufficiently resiliency so that under many conditions the marking post can return to the erect condition shown in FIG. 3.

I claim:

1. A hollow resilient one piece marker post for indicating the presence of an object comprising:

an elongated member, said elongated member including a first panel having a first edge and a second edge, a second panel having a first edge and a second edge and a third panel having a first edge and a second edge, said elongated member further including a first radiused corner member having a first edge and a second edge, a second radiused corner member having a first edge and a second edge and a third radiused corner member having a first edge and a second edge, said first panel first edge integrally joined with said first radiused corner first edge and said second panel second edge integrally joined with second edge of said first radiused corner, said second panel first edge integrally joined with said second radiused corner first edge, said third panel second edge integrally joined with second edge of said second radiused corner and said third panel first edge integrally joined with said third radiused corner member first edge, said third radiused corner member second edge integrally formed with said second edge of said first panel to thereby form a triangular shaped cross section; and a first integral web extending from said first panel to said second panel said first integral web spaced inwardly away from said first radiused corner to create a gap therebetween, a second integral web extending from said second panel to said third panel said second integral web spaced inwardly away from said second radiused corner to create a gap therebetween and a third integral web extending from said third panel to said first panel said third integral web spaced inwardly away from said third radiused corner to create a gap therebetween with said webs cooperating to provide resiliency to said marker post so that when said marker post is bent by an object, the marker post can return to its original condition when the object is removed.

2. The resilient one piece marker post of claim 1 wherein the elongated member is made of polycarbonate.

3. The resilient one-piece marker post of claim 1 wherein the elongated member includes a cap for covering a first end of said elongated member to prevent rain from entering into said elongated member.

4. The resilient one-piece marker post of claim 1 wherein the elongated member has sufficient stiffness to permit the marker post to be driven into a top layer of soil.

5. The marker post of claim 1 wherein the elongated hollow member includes a cap to cover an end of said hollow elongated member.

* * * * *